United States Patent [19]

Jobe

[11] Patent Number: 4,512,465

[45] Date of Patent: Apr. 23, 1985

[54] GOLF BAG ACCESSORY

[76] Inventor: Howard L. Jobe, 6500 Capitol Dr., Greenbelt, Md. 20770

[21] Appl. No.: 554,287

[22] Filed: Nov. 22, 1983

[51] Int. Cl.[3] ..... A63B 55/00

[52] U.S. Cl. ..... 206/315.4; 150/52 G

[58] Field of Search ..... 211/60 G, 70.2; 248/96; 150/52 G; 206/315.2, 315.3, 315.4, 315.5, 315.6, 315.7, 315.8

[56] References Cited

U.S. PATENT DOCUMENTS

| | | | |
|---|---|---|---|
| 699,391 | 5/1902 | Johnson | 206/315.2 X |
| 1,227,657 | 5/1917 | Pierce | 206/315.6 |
| 1,314,171 | 8/1919 | Vogel | 206/315.2 |
| 1,570,510 | 1/1926 | McQuerk | 206/315.4 |
| 1,826,216 | 10/1931 | Johnson | 206/315.6 |
| 2,035,529 | 3/1936 | Bucklin | 150/52 G |
| 2,508,264 | 5/1950 | Johnson | 206/315.6 X |
| 2,534,096 | 12/1950 | Zapoleon | 206/315.6 |
| 2,564,318 | 8/1951 | Wick | 206/315.2 |
| 2,716,432 | 8/1955 | Duffy | 206/315.2 |
| 2,718,251 | 9/1955 | Barbato | 206/315.4 X |
| 2,747,636 | 5/1956 | Couture | 150/52 G |
| 2,752,973 | 7/1956 | Stamp | 206/315.6 |
| 2,907,364 | 10/1959 | Trenery | 206/315.4 X |
| 3,059,681 | 10/1962 | Lorbeski | 206/315.4 X |
| 4,091,977 | 5/1978 | Luttbeg | 206/315.4 |
| 4,173,241 | 11/1979 | Stock | 206/315.6 |

*Primary Examiner*—William Price
*Assistant Examiner*—Sue A. Weaver
*Attorney, Agent, or Firm*—Brady, O'Boyle & Gates

[57] ABSTRACT

A device for protecting golf clubs from damage due to both longitudinal and lateral compaction while the clubs are being transported in a golf bag or the like and which is further protected by either an oversized flexible zippered travel cover, an attached hood, or both. The protective device is comprised of a rounded upper end portion formed of rigid metal or the like which is operable to encircle the club heads of the longer clubs and being integral with at least one longitudinal support member which fits down into the golf bag while projecting upwardly past the upper opening or collar thereof, with the overall length of the structure being at least equal to or slightly longer than the longest club in the bag, normally a driver. In its preferred form, the protecting device is comprised of a circular metal ring which is secured to the end of a single elongated support rod by downwardly projecting arcuate connecting members so that a concave configuration is formed to receive the heads of one or more golf clubs therein. Additionally, an extension member is attachable to the opposite end of the support rod for lengthening the structure to accommodate extra length clubs.

12 Claims, 5 Drawing Figures

GOLF BAG ACCESSORY

BACKGROUND OF THE INVENTION

This invention relates generally to golf equipment and more particularly to a device which is adapted to protect golf clubs from damage due to rough handling encountered during travel and/or storage.

Means presently known for protecting a golf bag and its contents during travel generally consists in the utilization of a hood which is attached to the upper collar portion of a golf bag or a travel bag or cover which is essentially an oversized flexible bag made from canvas or the like into which a golf bag is placed and thereafter closed, for example, by means of a zipper. More recently, a substantially rigid structure has been proposed somewhat resembling an oversized golf bag which is separable or otherwise opened for receiving the golf bag and its contents. This structure, while providing adequate protection for the equipment contained therein, its bulk provides a relatively large and clumsy piece of equipment which provides a golfer an undue amount of trouble during travel. With respect to the use of the golf bag with an attached hood or the utilization of a travel bag, these two modes have a little realized inherent limitation in that while the club heads are restrained from falling out of the golf bag and are protected from some abuse, there is no protection from violent longitudinal and lateral compacting forces which can be applied to the top end and side of the golf bag as a result of rough baggage handling received during travel. This situation is particularly true with respect to airline travel, but it can be appreciated that the same conditions can be encountered in other forms of transportation such as when the equipment is being transported in a bus or the trunk of an automobile.

Accordingly, it is an object of the present invention to provide an improvement in means for protecting golf equipment, particularly golf clubs.

Another object of the present invention is to provide a means for protecting golf clubs during travel.

Still another object of the present invention is to provide a means for protecting golf clubs during transportation and/or storage.

SUMMARY

These and other objects are accomplished by means of a golf club protective device which is adapted to be inserted into means for carrying golf clubs for protecting the clubs and more particularly the shafts and heads thereof from damage due to external longitudinal and lateral compressional forces normally occurring as a result of rough handling. The protective device comprises a substantially rigid piece of apparatus including an open concave top portion adapted to envelop the heads of the longer golf clubs, such as the woods, and at least one elongated rod type support member integral therewith which is adapted to be inserted lengthwise in the carrying means which may be, for example, a golf bag and having an overall length at least equal to or greater than the length of the longest club carried in the bag. In its preferred form, the invention is comprised of a single rod member to which is secured a circular ring by a plurality of downwardly projecting arcuate members which are welded to the upper end of the rod. When desirable, a relatively short length extensioning member is fitted to the bottom end of the support rod for accommodating extra length clubs.

DESCRIPTION OF THE PREFERRED EMBODIMENTS

Figure 1:
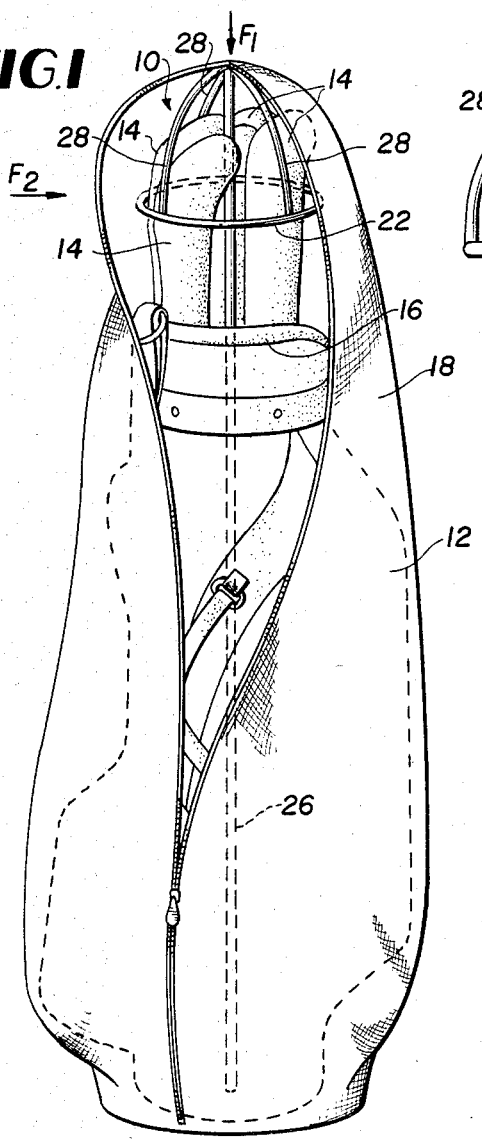
FIG. 1 is a perspective view of the preferred embodiment of the invention located within a golf bag which is further located in a flexible zippered travel bag or cover.

Referring now to the figures, FIG. 1 is intended to disclose the manner in which the present invention is typically utilized. As shown, the invention comprises a protective device 10 utilized as an accessory for a golf bag 12 for protecting one or more golf clubs 14, illustrated in FIG. 1, covered by head covers and normally being the longer "wood" clubs in a golf club set which have relatively longer shafts than the "irons", not shown. The protective device 10, moreover, is manually inserted and fits into the golf bag 12 but additionally extends above the top collar portion 16 thereof so as to encircle and envelop the clubs 14. Further, as shown in FIG. 1, the protective device 10 while having an overall length longer than the golf clubs 14 is dimensioned so that it is adapted to fit inside of a conventional zippered travel bag or cover 18 along with the golf bag 12 and the golf clubs 14. It can be appreciated when considering the overall structure as depicted in FIG. 1, that the present invention operates in concert with the travel bag 18 to further protect the golf clubs 14 from harmful externally applied longitudinal and lateral compressional forces $F_1$ and $F_2$ which might be encountered during baggage handling, transportation and/or storage.

Figure 2:
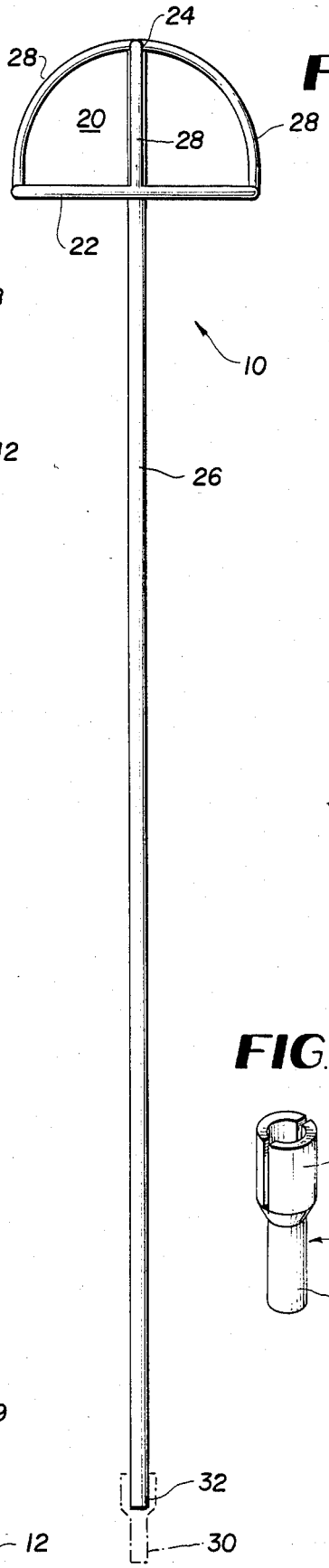
FIG. 2 is a side elevational view of the preferred embodiment of the subject invention.
Figure 3:
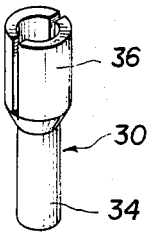
FIG. 3 is an enlarged perspective view of an extension member which can be fitted on the lower end of the embodiment shown in FIG. 2.

Referring now to FIG. 2, the preferred embodiment of the invention is illustrated therein and is shown including a golf club head enveloping end portion 20 comprised of a circular rigid metal ring member 22 which is attached to the upper end 24 of a relatively long centrally located metal rod member 26 which is adapted to fit down inside of the golf bag 12 as shown in FIG. 1. The ring 22 is secured to the upper end of the rod 26 by means of a plurality of downwardly projecting arcuate connecting elements 28 which as shown in FIG. 2, can be formed by two generally semi-circular metal arms arranged orthogonally with respect to one another. The diameter of the ring 22, moreover, is preferably selected to have a dimension substantially equal to the crosswise dimension of the collar 16 of the golf bag 12. The length of the rod 26 is at least equal to the longest club carried by the golf bag 12. The longest club in a set of golf clubs normally comprises the driver whose standard length typically varies from 42½ inches up to 44 inches. For a longer length club, the present invention contemplates and further includes an extension member 30 which can be manually slipped onto the shaft 26 and thus add up to two and one half more inches to the overall length of the device 10 for accommodating extra length clubs. The extension member 30 is shown by way of a phantom view attached to the lower end 32 of the support rod 26. The extension member 30 is shown in detail in FIG. 3 and includes an end portion 34 which is adapted to supply the extra length to the support rod 26 and a slotted collar 36 which is adapted to provide a press fit engagement with the end 32 of the rod 26.

Figure 4:
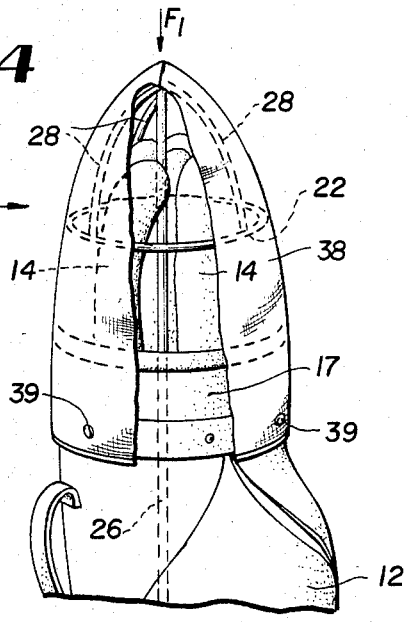
FIG. 4 is a partial perspective view illustrative of the preferred embodiment of the invention located within a golf bag having a hood attached thereto.

The entire assembly is relatively simple in construction, yet provides a degree of protection not heretofore obtainable when transporting golf clubs and bag in a travel bag or cover 18 as shown in FIG. 2. The protection afforded by the subject invention is not limited to that shown in FIG. 1 because it can be used equally as well with a conventional hood which is normally supplied with a golf bag and which is normally stowed in a side pocket until it is needed. This type of use is further shown in FIG. 4 wherein a golf bag hood 38 is shown attached by means of snap fasteners 39 to the upper body 17 of the golf bag 12 over the protective device 10 to provide further protection for the golf clubs 14 against any undesired compressive forces which the bag may come in contact with during transit and/or storage. When desirable, both the hood 38 and the travel cover 18 can be used together.

Figure 5:
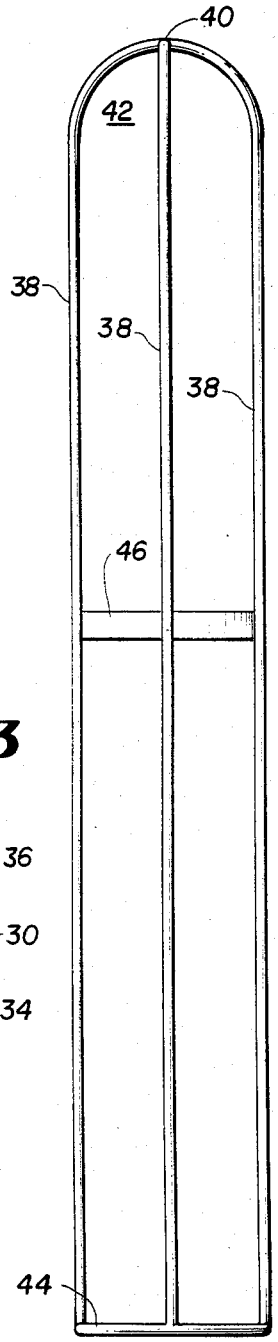
FIG. 5 is a side elevational view of a second embodiment of the invention.

A second embodiment of the invention is shown in FIG. 5 wherein the ring 22 and the single rod 26 are replaced by four equal length rods 38 which are arcuately curved at their upper ends and joined at the top 40 to provide club head enveloping upper end portion 42 which corresponds to the end portion 20 of FIG. 2. The four rods 38 terminate at their bottom extremities in circular ring 44 while an intermediate support member is provided by means of a circular band 46. While the configuration shown in FIG. 5 is adapted to provide the same type of protection as the embodiment of FIG. 2, it requires for its insertion into the golf bag the removal of the golf club separators, not shown, which are normally provided at the top collar portion 16 of the golf bag 12 which is shown by reference numeral 16 in FIG. 1.

Having thus shown and described what is at present considered to be the preferred embodiment of the subject invention, it should be understood that the same has been made by way of illustration and not limitation. Accordingly, all modifications, alterations and changes coming within the spirit and scope of the invention as set forth in the appended claims are herein meant to be included.

I claim:

1. A protective device utilized with means for carrying sports equipment, particularly golf clubs, and being operable to protect the golf clubs during travel and/or storage, comprising:

substantially rigid downwardly facing concave club head protecting means for surrounding and enveloping the heads of said clubs, and elongated support means integral with said club head protecting means;

said elongated support means further comprising a central rod member;

said club head protecting means further comprising a base member surrounding said rod member and a plurality of downwardly projecting and upwardly converging connecting members connecting one end of said rod member to said base member;

said rod member being insertable in said carrying means and having a predetermined length such that the overall length of the protective device is greater than the longest club carried, whereby damage occurring as a result of undesired externally applied longitudinal and lateral forces is prevented.

2. The device as defined by claim 1 wherein said base member comprises a generally circular base member and said connecting members comprise generally curved connecting members.

3. The device as defined by claim 1 wherein said base member comprises a ring member located below said one end of said rod member and said connecting members comprise arcuate members.

4. The device as defined by claim 3 wherein said plurality of arcuate members define at least two semicircular rigid members orthogonally disposed relative to one another.

5. The device as defined by claim 3 wherein said sports equipment carrying means comprises a golf bag and wherein said ring member has a diameter substantially equal to the width of the upper opening in said golf bag wherein a set of golf clubs are adapted to be inserted and carried thereby.

6. The device as defined by claim 5 wherein said location of said ring member is intermediate the top opening of said golf bag and said one end of said rod member.

7. The device as defined by claim 5 wherein said location of said ring member is substantially midway between the top of said golf bag and said one end of said rod member.

8. The device as defined by claim 1 and additionally including means attachable to the other end of said rod member for selectively increasing the overall length of said device to accommodate extra length golf clubs.

9. The device as defined by claim 8 wherein said attachment means comprises a relatively short rigid extension member having a relatively smaller outer end portion and an enlarged inner end portion including a bore which is adapted to engage said other end of said rod member.

10. The device as defined by claim 9 wherein said enlarged inner end portion of said extension member includes a longitudinal slot adjacent said bore to facilitate attachment of said extension member to said rod member.

11. The device as defined by claim 1 wherein said means for carrying includes a golf bag and a travel cover completely enclosing both said golf bag and said device when in place in said golf bag.

12. The device as defined by claim 1 wherein said means for carrying includes a golf bag and a golf bag hood attached thereto which thereby encloses said device when in place in said golf bag.

* * * * *